US007851112B2

(12) United States Patent
Wu et al.

(10) Patent No.: US 7,851,112 B2
(45) **Date of Patent: *Dec. 14, 2010**

(54) THIOPHOSPHATE CONTAINING PHOTOCONDUCTORS

(75) Inventors: Jin Wu, Webster, NY (US); Kenny-Tuan Dinh, Webster, NY (US); Kathleen M. Carmichael, Williamson, NY (US); Michael S. Roetker, Webster, NY (US); Liang-Bih Lin, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 1051 days.

This patent is subject to a terminal disclaimer.

(21) Appl. No.: 11/605,522

(22) Filed: Nov. 28, 2006

(65) Prior Publication Data

US 2008/0124639 A1 May 29, 2008

(51) Int. Cl.
*G03G 15/02* (2006.01)

(52) U.S. Cl. ..... 430/58.05; 430/58.65; 430/59.1; 430/59.2; 430/59.4; 430/59.5; 430/64; 430/108.5

(58) Field of Classification Search ..... 430/58.05, 430/58.65, 59.1, 59.2, 59.4, 59.5, 64, 108.5
See application file for complete search history.

(56) References Cited

U.S. PATENT DOCUMENTS

| | | | | |
|---|---|---|---|---|
| 4,265,990 | A | 5/1981 | Stolka et al. | |
| 4,443,528 | A | 4/1984 | Tamura et al. | |
| 4,555,463 | A | 11/1985 | Hor et al. | |
| 4,587,189 | A | 5/1986 | Hor et al. | |
| 4,921,769 | A | 5/1990 | Yuh et al. | |
| 5,473,064 | A | 12/1995 | Mayo et al. | |
| 5,482,811 | A | 1/1996 | Keoshkerian et al. | |
| 5,521,306 | A | 5/1996 | Burt et al. | |
| 6,156,468 | A | 12/2000 | Wehelie et al. | |
| 6,177,219 | B1 | 1/2001 | Yuh et al. | |
| 6,255,027 | B1 | 7/2001 | Wehelie et al. | |
| 6,913,863 | B2 | 7/2005 | Wu et al. | |
| 7,037,631 | B2 | 5/2006 | Wu et al. | |
| 7,468,231 | B2 * | 12/2008 | Lin et al. | 430/75 |
| 7,476,477 | B2 * | 1/2009 | Wu et al. | 430/58.8 |
| 7,498,108 | B2 * | 3/2009 | Wu et al. | 430/59.1 |
| 7,541,122 | B2 * | 6/2009 | Wu et al. | 430/58.2 |
| 2006/0177748 | A1 | 8/2006 | Wu et al. | |

FOREIGN PATENT DOCUMENTS

| | | | |
|---|---|---|---|
| EP | 1 205 808 | A | 5/2002 |

* cited by examiner

*Primary Examiner*—Thorl Chea
(74) *Attorney, Agent, or Firm*—Oliff & Berridge, PLC

(57) ABSTRACT

A photoconductor containing an optional supporting substrate, a thiophosphate containing photogenerating layer, and a charge transport layer which includes a polyhedral oligomeric silsesquioxane (POSS)-containing material and an optional thiophosphate.

33 Claims, No Drawings

THIOPHOSPHATE CONTAINING PHOTOCONDUCTORS

CROSS REFERENCE TO RELATED APPLICATIONS

In copending U.S. application Ser. No. 11/605,523, U.S. Publication No. 20080124640, filed Nov. 28, 2006, the disclosure of which is totally incorporated herein by reference, there is illustrated an imaging member comprising an optional supporting substrate; a photogenerating layer; and at least one charge transport layer wherein at least one of the charge transport layers is comprised of at least one charge transport component, at least one thiophosphate and at least one polyhedral oligomeric silsesquioxane (POSS)-containing material.

In copending U.S. application Ser. No. 11/453,743, now U.S. Pat. No. 7,498,108, filed Jun. 15, 2006 on Thiophosphate Containing Photoconductors by Jin Wu et al., the disclosure of which is totally incorporated herein by reference, there is illustrated an imaging member comprising an optional supporting substrate, a photogenerating layer, and at least one charge transport layer, and wherein the photogenerating layer contains at least one thiophosphate.

U.S. application Ser. No. 11/485,645, now U.S. Pat. No. 7,560,206, filed Jul. 12, 2006 on Silanol Containing Photoconductors by Jin Wu et al., the disclosure of which is totally incorporated herein by reference.

U.S. application Ser. No. 11/453,392, now U.S. Pat. No. 7,479,358, filed Jun. 15, 2006 on Ether Phosphate Containing Photoconductors by Jin Wu et al., the disclosure of which is totally incorporated herein by reference.

U.S. application Ser. No. 11/453,621, now U.S. Pat. No. 7,445,876, filed Jun. 15, 2006 on Ether Phosphate Containing Photoconductors by Jin Wu et al., the disclosure of which is totally incorporated herein by reference.

U.S. application Ser. No. 11/453,621, now U.S. Pat. No. 7,459,250, filed Jun. 15, 2006 on Polyphenyl Ether Containing Photoconductors by Jin Wu et al., the disclosure of which is totally incorporated herein by reference.

U.S. application Ser. No. 11/453,379, now U.S. Pat. No. 7,507,510, filed Jun. 15, 2006 on Polyphenyl Ether Phosphate Containing Photoconductors by Jin Wu et al., the disclosure of which is totally incorporated herein by reference.

U.S. application Ser. No. 11/453,742 now U.S. Pat. No. 7,452,643, filed Jun. 15, 2006 on Polyphenyl Ether Phosphate Containing Photoconductors by Jin Wu et al., the disclosure of which is totally incorporated herein by reference.

U.S. application Ser. No. 11/453,740, now U.S. Pat. No. 7,476,478, filed Jun. 15, 2006 on Polyphenyl Thioether Containing Photoconductors by Jin Wu et al., the disclosure of which is totally incorporated herein by reference.

U.S. application Ser. No. 11/453,607, now U.S. Pat. No. 7,462,432, filed Jun. 15, 2006 on Polyphenyl Thioether Phosphate Containing Photoconductors by Jin Wu et al, the disclosure of which is totally incorporated herein by reference.

U.S. application Ser. No. 11/453,739, now U.S. Pat. No. 7,468,229, filed Jun. 15, 2006 on Polyphenyl Thioether Phosphate Containing Photoconductors by Jin Wu et al., the disclosure of which is totally incorporated herein by reference.

U.S. application Ser. No. 11/453,613, now U.S. Pat. No. 7,476,477, filed Jun. 15, 2006 on Thiophosphate Containing Photoconductors by Jin Wu et al., the disclosure of which is totally incorporated herein by reference.

U.S. application Ser. No. 11/453,489, now U.S. Pat. No. 7,491,480, filed Jun. 15, 2006 on Thiophosphate Containing Photoconductors, by Jin Wu et al., the disclosure of which is totally incorporated herein by reference.

U.S. application Ser. No. 11/485,550, now U.S. Pat. No. 7,541,122, filed Jul. 12, 2006 on Silanol Containing Photoconductors by Jin Wu et al., the disclosure of which is totally incorporated herein by reference.

A number of the components and amounts thereof of the above copending applications, such as the supporting substrates, resin binders, photogenerating layer components, antioxidants, charge transport components, hole blocking layer components, adhesive layers, silanols, thiophosphates, and the like, may be selected for the members of the present disclosure in embodiments thereof.

BACKGROUND

This disclosure is generally directed to layered imaging members, photoreceptors, photoconductors, and the like. More specifically, the present disclosure is directed to multilayered flexible, belt imaging members, or devices comprised of an optional supporting medium like a substrate, a photogenerating layer optionally containing a thiophosphate, and a charge transport layer, including a plurality of charge transport layers, such as a first charge transport layer and a second charge transport layer, an optional adhesive layer, an optional hole blocking or undercoat layer, and an optional overcoating layer, and wherein at least one of the charge transport layers contains at least one charge transport component, a polymer or resin binder, a polyhedral oligomeric silsesquioxane (POSS)-containing material, a thiophosphate, and an optional antioxidant. Moreover, at least one of the charge transport layers and the photogenerating layer can contain a thiophosphate, that is for example, a mixture of a polyhedral oligomeric silsesquioxane (POSS)-containing material and a thiophosphate can be included in at least one charge transport layer, and a thiophosphate can be contained in the photogenerating layer. At least one in embodiments refers, for example, to one, to from 1 to about 10, to from 2 to about 7; to from 2 to about 4, to two, and the like. Moreover, the POSS-containing material can be added to the at least one of the charge transport layers, that is for example, instead of being dissolved in the charge transport layer solution, the POSS-containing material can be added to the charge transport as a dopant, and more specifically, the POSS-containing material can be added to the top charge transport layer.

Yet more specifically, there is disclosed a photoconductor comprised of a supporting substrate, a photogenerating layer, and at least one charge transport layer where a mixture of a POSS-containing material and a thiophosphate is contained in a first pass charge transport layer, a second pass charge transport layer, or both the first and second pass charge transport layers to primarily permit scratch resistant photoconductors and enable an acceptable low $V_r$ and minimization or prevention of $V_r$ cycle up, and optionally where the photogenerating layer contains a thiophosphate which primarily enables an acceptable low $V_r$ and minimization or prevention of $V_r$ cycle up. Also, the photoconductor in embodiments is comprised of a thiophosphate photogenerating layer, at least one thiophosphate charge transport layer, and at least one charge transport layer comprised of a mixture of a POSS-containing material and a thiophosphate.

A number of advantages are associated with the photoconductors disclosed as indicated herein, and in embodiments, for example, excellent surface scratch resistance, increased photogenerating pigment sensitivity, minimal ghosting with substantially no light shock, excellent wear resistance, extended lifetimes, elimination or minimization of imaging member scratches on the surface layer or layers of the member, and which scratches can result in undesirable print failures where, for example, the scratches are visible on the final prints generated. Additionally, in embodiments the imaging members disclosed herein possess in embodiments excellent, and in a number of instances low $V_r$ (residual potential), and allow the substantial prevention of $V_r$ cycle up when appropriate; high sensitivity; low acceptable image ghosting characteristics; low background and/or minimal charge deficient spots (CDS); and desirable toner cleanability.

Also included within the scope of the present disclosure are methods of imaging and printing with the photoconductor devices illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, flexible belts disclosed herein can be selected for the Xerox Corporation iGEN3® machines that generate with some versions over 100 copies per minute. Processes of imaging, especially xerographic imaging and printing, including digital, and/or color printing, are thus encompassed by the present disclosure. The imaging members are in embodiments sensitive in the wavelength region of, for example, from about 400 to about 900 nanometers, and in particular from about 650 to about 850 nanometers, thus diode lasers can be selected as the light source. Moreover, the imaging members of this disclosure are useful in high resolution color xerographic applications, particularly high speed color copying and printing processes.

REFERENCES

There is illustrated in U.S. Pat. No. 7,037,631, the disclosure of which is totally incorporated herein by reference, a photoconductive imaging member comprised of a supporting substrate, a hole blocking layer thereover, a crosslinked photogenerating layer and a charge transport layer, and wherein the photogenerating layer is comprised of a photogenerating component and a vinyl chloride, allyl glycidyl ether, hydroxy containing polymer.

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound and an amine hole transport dispersed in an electrically insulating organic resin binder.

Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methylphenyl)-1,1'-biphenyl-4,4'-diamine dispersed in a polycarbonate binder as a hole transport layer. The above components, such as the photogenerating compounds and the aryl amine charge transport, can be selected for the imaging members of the present disclosure in embodiments thereof.

In U.S. Pat. No. 4,921,769, the disclosure of which is totally incorporated herein by reference, there are illustrated photoconductive imaging members with blocking layers of certain polyurethanes.

Illustrated in U.S. Pat. Nos. 6,255,027; 6,177,219, and 6,156,468, the disclosures of which are totally incorporated herein by reference, are, for example, photoreceptors containing a hole blocking layer of a plurality of light scattering particles dispersed in a binder, reference for example, Example I of U.S. Pat. No. 6,156,468, the disclosure of which is totally incorporated herein by reference, wherein there is illustrated a hole blocking layer of titanium dioxide dispersed in a specific linear phenolic binder of VARCUM™, available from OxyChem Company.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water; concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, where a pigment precursor Type I chlorogallium phthalocyanine is prepared by the reaction of gallium chloride in a solvent, such as N-methylpyrrolidone, present in an amount of from about 10 parts to about 100 parts, with 1,3-diiminoisoindolene ($DI^3$) in an amount of from about 1 part to about 10 parts, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

The appropriate components, and processes of the above recited patents may be selected for the present disclosure in embodiments thereof.

SUMMARY

Disclosed in embodiments are imaging members with many of the advantages illustrated herein, such as extended lifetimes of service of, for example, in excess of about 3,000,000 imaging cycles; excellent electronic characteristics; stable electrical properties; low image ghosting; low background and/or minimal charge deficient spots (CDS); resistance to charge transport layer cracking upon exposure to the vapor of certain solvents; excellent surface characteristics; excellent wear resistance; compatibility with a number of toner compositions; the avoidance of or minimal imaging member scratching characteristics; consistent $V_r$ (residual potential) that is substantially flat or no change over a number of imaging cycles as illustrated by the generation of known PIDC (Photoinduced Discharge Curve), and the like. Also disclosed are layered anti-scratch photoresponsive imaging members which are responsive to near infrared radiation of from about 700 to about 900 nanometers.

Further disclosed are layered flexible photoresponsive imaging members with sensitivity to visible light.

Moreover, disclosed are rigid or drum and layered belt photoresponsive or photoconductive imaging members with mechanically robust and solvent resistant charge transport layers.

Additionally disclosed are flexible imaging members with optional hole blocking layers comprised of metal oxides, phenolic resins, and optional phenolic compounds, and which phenolic compounds contain at least two, and more specifically, two to ten phenol groups or phenolic resins with, for example, a weight average molecular weight ranging from about 500 to about 3,000 permitting, for example, a hole blocking layer with excellent efficient electron transport which usually results in a desirable photoconductor low residual potential $V_{low}$.

Also disclosed are layered flexible belt photoreceptors containing a wear resistant, and anti-scratch layer or layers, and where the surface hardness of the member is increased by the addition of suitable POSS-containing materials and suitable thiophosphates, and where the photoreceptors exhibit low background and/or minimal CDS, low ghosting, and prevention of $V_r$ cycle up, which can be caused primarily by photoconductor cycling.

EMBODIMENTS

Aspects of the present disclosure relate to an imaging member comprising an optional supporting substrate, a photogenerating layer, and at least one charge transport layer comprised of at least one charge transport component, and a mixture of at least one thiophosphate and at least one POSS-containing material; a photoconductor comprising a substrate, a thiophosphate containing photogenerating layer, and at least one charge transport layer comprised of at least one charge transport component, and at least one POSS-containing material, and wherein the POSS-containing material is, for example, selected from the group comprised of polyhedral oligomeric silsesquioxane, polyhedral oligomeric silsesquioxane alcohols and phenols, polyhedral oligomeric silsesquioxane alkoxysilanes, polyhedral oligomeric silsesquioxane amines, polyhedral oligomeric silsesquioxane chlorosilanes, polyhedral oligomeric silsesquioxane epoxides, polyhedral oligomeric silsesquioxane esters, fluoroalkyl polyhedral oligomeric silsesquioxane, polyhedral oligomeric silsesquioxane halides, polyhedral oligomeric silsesquioxane isocyanates, polyhedral oligomeric silsesquioxane methacrylates and acrylates, polyhedral oligomeric silsesquioxane nitrites, norbornenyl polyhedral oligomeric silsesquioxane, polyhedral oligomeric silsesquioxane olefins, polyhedral oligomeric silsesquioxane phosphines, polyhedral oligomeric silsesquioxane silanes, polyhedral oligomeric silsesquioxane silanols, polyhedral oligomeric silsesquioxane thiols, and polyhedral oligomeric silsesquioxane-containing polymers, where the polyhedral oligomeric silsesquioxane (POSS) contains $(RSiO_m)_n$ wherein n is from about 2 to about 30, and more specifically, wherein n is 7, 8, 10, and 12, m is from about 0.5 to about 2.5, from about 1 to about 2, from about 1.2 to about 1.8, or 1.5, and R is independently selected, for example, from the group consisting of a suitable hydrocarbon, such as alkyl, alkoxy, aryl, and substituted derivatives thereof such as those containing an alcohol, phenol, thiol, alkoxysilane, amine, chlorosilane, epoxide, ester, fluoroalkyl, halide, isocyanate, methacrylate, acrylate, nitrile, norbornenyl, olefin, phosphine, silane, silanol, styrene thereof, and mixtures thereof. The diameter size of the POSS-containing material can vary depending on a number of factors, and this size is, for example, from about 0.7 to about 50 nanometers, or from 1 to about 3 nanometers. Also disclosed is a photoconductor comprised in sequence of a substrate, a thiophosphate containing photogenerating layer, and at least one, such as from 1 to 7, from 1 to 4, from 1 to 3, and 2, charge transport layer comprised of at least one charge transport component, and a mixture of a thiophosphate and a POSS-containing material wherein the POSS-containing material can be present in each charge transport layer, the thiophosphate can be present in the photogenerating layer, and more specifically, where the POSS-containing material is present in a second pass charge transport layer, and a thiophosphate is present in the photogenerating layer or a first pass charge transport layer, wherein the POSS-containing material is, for example, selected from the group comprised of polyhedral oligomeric silsesquioxane, polyhedral oligomeric silsesquioxane alcohols and phenols, polyhedral oligomeric silsesquioxane alkoxysilanes, polyhedral oligomeric silsesquioxane amines, polyhedral oligomeric silsesquioxane chlorosilanes, polyhedral oligomeric silsesquioxane epoxides, polyhedral oligomeric silsesquioxane esters, fluoroalkyl polyhedral oligomeric silsesquioxane, polyhedral oligomeric silsesquioxane halides, polyhedral oligomeric silsesquioxane isocyanates, polyhedral oligomeric silsesquioxane methacrylates and acrylates, polyhedral oligomeric silsesquioxane nitrites, norbornenyl polyhedral oligomeric silsesquioxane, polyhedral oligomeric silsesquioxane olefins, polyhedral oligomeric silsesquioxane phosphines, polyhedral oligomeric silsesquioxane silanes, polyhedral oligomeric silsesquioxane silanols, polyhedral oligomeric silsesquioxane thiols, polyhedral oligomeric silsesquioxane-containing polymers; and mixtures thereof; and wherein the POSS-containing material and thiophosphate are each present in an amount of from about 0.01 to about 30, from about 1 to about 20, or from about 5 to about 10 weight percent in the charge transport layer, and the thiophosphate is present in an amount of from about 0.1 to about 40, or from about 1 to about 20, or from about 5 to about 15 weight percent in the photogenerating layer, and the thiophosphate is of the formulas

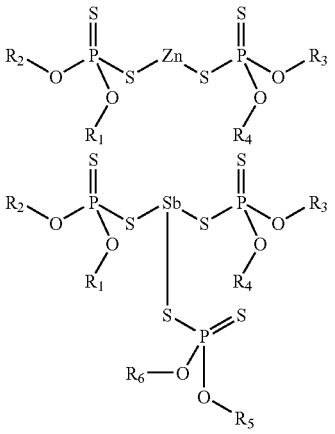

wherein $R_1$, $R_2$, $R_3$, $R_4$, $R_5$ and $R_6$ each independently represents a hydrogen atom, a suitable hydrocarbon like alkyl, cycloalkyl, aryl, alkylaryl or arylalkyl; and a photoconductor comprising a substrate, a photogenerating layer, and a plurality of charge transport layers comprised of at least one, for example 1 to about 8, charge transport layers, and wherein the photogenerating layer is comprised of a photogenerating pigment or pigments, and at least one dialkyldithiophosphate of the formulas

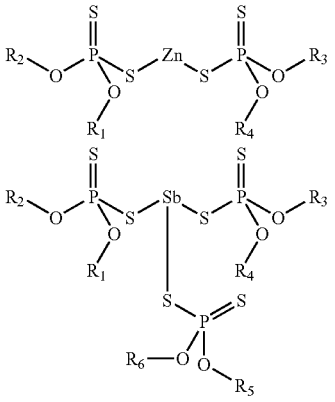

wherein $R_1$, $R_2$, $R_3$, $R_4$, $R_5$ and $R_6$ each independently represents a hydrogen atom or a suitable hydrocarbon, and more specifically, wherein $R_1$, $R_2$, $R_3$, $R_4$, $R_5$ and $R_6$ are alkyl with from 1 to about 20 carbon atoms, cycloalkyl with from about 6 to about 26 carbon atoms, aryl, alkylaryl or arylalkyl with from about 7 to about 50 carbon atoms, a hydrocarbyl with from about 3 to about 20 carbon atoms, containing an ester, an ether, an alcohol or a carboxy group; and a straight chain or branched chain alkyl with from about 2 to about 18 carbon atoms. Examples of alkyl and alkoxy groups include methyl, ethyl, propyl, isopropyl, butyl, isobutyl, pentyl, hexyl ethylhexyl, and the like, and mixtures thereof; and the corresponding alkoxides.

Specific examples of metal dialkyldithiophosphates include molybdenum di(2-ethylhexyl)dithiophosphate, zinc diethyidithiophosphate, antimony diamyldithiophosphate, and the like. Available zinc dialkyldithiophosphates include ELCO™ 102, 103, 108, 114, and 121, available from Elco Corporation, Cleveland, Ohio. A number of the thiophosphates can contain a certain amount of petroleum distillates, mineral oils such as ValPar™ 500, available from Valero Energy Corporation, San Antonio, Tex. Commercially available molybdenum dialkyldithiophosphates include MOLYVAN™ L (molybdenum di(2-ethylhexyl)phosphorodithioate), available from R.T. Vanderbilt Company, Inc., Norwalk, Conn. Commercially available antimony dialkyldithiophosphates include VANLUBE™ 622 and 648 (antimony dialkylphosphorodithioate), available from R.T. Vanderbilt Company, Inc., Norwalk, Conn.

Various effective amounts of the thiophosphates, which in embodiments function primarily as permitting excellent photoconductor electricals, although in theory there could be interactions between the thiophosphates and other components, such as the photogenerating pigment, can be added to each charge transport layer and/or to the photogenerating layer components in an amount, for example, of from about 0.01 to about 30 weight percent, from about 0.1 to about 10 weight percent, or from about 0.5 to about 5 weight percent in the charge transport layer or layers; and from about 0.1 to about 40 weight percent, from about 1 to about 20 weight percent, or from about 5 to about 15 weight percent in the photogenerating layer, and wherein the photogenerating layer and at least one charge transport layer include a resin binder; wherein the at least one charge transport layer is from 2 to about 7, and the photogenerating layer is situated between the substrate and the at least one charge transport layer; a drum, or flexible imaging member comprising a supporting substrate, a photogenerating layer, and at least two charge transport layers each of which contain a mixture of a thiophosphate and a POSS-containing material, wherein the POSS-containing material is selected from the group comprised of at least one of a polyhedral oligomeric silsesquioxane, polyhedral oligomeric silsesquioxane alcohols and phenols, polyhedral oligomeric silsesquioxane alkoxysilanes, polyhedral oligomeric silsesquioxane amines, polyhedral oligomeric silsesquioxane chlorosilanes, polyhedral oligomeric silsesquioxane epoxides, polyhedral oligomeric silsesquioxane esters, fluoroalkyl polyhedral oligomeric silsesquioxane, polyhedral oligomeric silsesquioxane halides, polyhedral oligomeric silsesquioxane isocyanates, polyhedral oligomeric silsesquioxane methacrylates and acrylates, polyhedral oligomeric silsesquioxane nitrites, norbornenyl polyhedral oligomeric silsesquioxane, polyhedral oligomeric silsesquioxane olefins, polyhedral oligomeric silsesquioxane phosphines, polyhedral oligomeric silsesquioxane silanes, polyhedral oligomeric silsesquioxane silanols, polyhedral oligomeric silsesquioxane thiols, polyhedral oligomeric silsesquioxane-containing polymers; a photoconductor as disclosed herein wherein the POSS-containing material is a POSS olefin, or a vinyl POSS such as OL1170™, available from Hybrid Plastics Inc., and the thiophosphate is a dialkyldithiophosphate or a zinc dialkyldithiophosphate (ZDDP) such as ELCO™ 103, available from Elco Corporation; a photoconductive member comprised of a substrate, a photogenerating layer thereover, at least one to about three charge transport layers thereover, a hole blocking layer, an adhesive layer wherein in embodiments the adhesive layer is situated between the photogenerating layer and the hole blocking layer, and wherein at least one of the charge transport layers and the photogenerating layer contain a dialkyldithiophosphate, and the charge transport layers also include a POSS-containing material, and known additives like antioxidants.

In embodiments thereof there is disclosed a photoconductive imaging member comprised of a supporting substrate, a photogenerating layer thereover, a charge transport layer, and an overcoating charge transport layer; a photoconductive member with a photogenerating layer of a thickness of from about 0.1 to about 10 microns, at least one transport layer each of a thickness of from about 5 to about 100 microns; a xerographic imaging apparatus containing a charging component, a development component, a transfer component, and a fixing component, and wherein the apparatus contains a photoconductive imaging member comprised of a supporting substrate, and thereover a layer comprised of a photogenerating pigment and a charge transport layer or layers, and thereover an overcoating charge transport layer, and where the transport layer is of a thickness of from about 10 to about 75 microns; a member wherein the POSS-containing material, or mixtures thereof is present in an amount of from about 0.1 to about 40 weight percent, or from about 6 to about 20 weight percent; a member wherein the photogenerating layer contains a photogenerating pigment present in an amount of from about 10 to about 95 weight percent; a member wherein the thickness of the photogenerating layer is from about 0.2 to about 4 microns; a member wherein the photogenerating layer contains an inactive polymer binder; a member wherein the binder is present in an amount of from about 20 to about 90 percent by weight, and wherein the total of all layer components is about 100 percent; a member wherein the photogenerating component is a hydroxygallium phthalocyanine or a titanyl phthalocyanine that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate or titanized polyethylene terephthalate; an imaging member wherein the photogenerating resinous binder is selected from the group consisting of known suitable polymers like polyesters, polyvinyl butyrals, polycarbonates, polystyrene-b-polyvinyl pyridine, and polyvinyl formals; an imaging member wherein the photogenerating pigment is a metal free phthalocyanine; an imaging member wherein each of the charge transport layers, especially a first and second layer, comprises

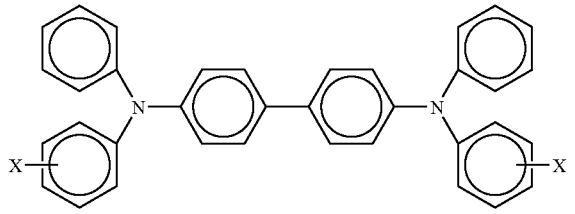

wherein X is selected from the group consisting of at least one of alkyl, alkoxy, and halogen such as methyl and chloride; and in embodiments where there is a total of four X substituents on each of the four terminating rings; an imaging member wherein alkyl and alkoxy contain from about 1 to about 15 carbon atoms; an imaging member wherein alkyl contains from about 1 to about 5 carbon atoms; an imaging member wherein alkyl is methyl; an imaging member wherein each of or at least one of the charge transport layers, especially a first and second charge transport layer, comprises

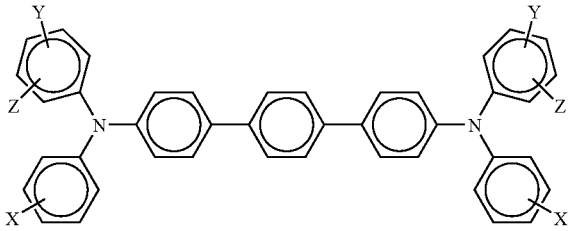

wherein X, Y and Z are independently selected from the group comprised of at least one of alkyl, alkoxy, aryl, and halogen, and in embodiments Z can be present, Y can be present or both Y and Z are present; or wherein the charge transport component is

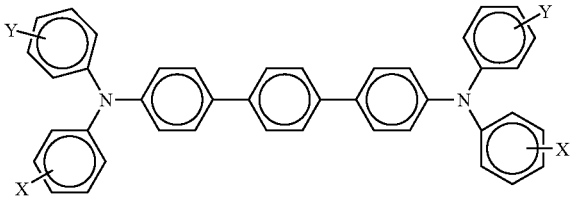

wherein X and Y are independently alkyl, alkoxy, aryl, a halogen, or mixtures thereof, an imaging member and wherein, for example, alkyl and alkoxy contains from about 1 to about 15 carbon atoms; alkyl contains from about 1 to about 5 carbon atoms; and wherein the resinous binder is selected from the group consisting of polycarbonates, polyarylates and polystyrene; an imaging member wherein the photogenerating pigment present in the photogenerating layer is comprised of chlorogallium phthalocyanine, titanyl phthalocyanine or Type V hydroxygallium phthalocyanine prepared by hydrolyzing a gallium phthalocyanine precursor by dissolving the hydroxygallium phthalocyanine in a strong acid, and then reprecipitating the resulting dissolved precursor in a basic aqueous media; removing the ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (2 theta+/−0.2°) 7.4, 9.8, 12.4, 16.2, 17.6, 18.4, 21.9, 23.9, 25.0, 28.1 degrees, and the highest peak at 7.4 degrees; a method of imaging wherein the imaging member is exposed to light of a wavelength of from about 400 to about 950 nanometers; a member wherein the photogenerating layer is situated between the substrate and the charge transport; a member wherein the charge transport layer is situated between the substrate and the photogenerating layer, and wherein the number of charge transport layers is 2; a member wherein the photogenerating layer is of a thickness of from about 0.5 to about 25 microns; a member wherein the photogenerating component amount is from about 0.05 weight percent to about 20 weight percent, and wherein the photogenerating pigment is dispersed in from about 10 weight percent to about 80 weight percent of a polymer binder; a member wherein the thickness of the photogenerating layer is from about 0.1 to about 11 microns; a member wherein the photogenerating and charge transport layer components are contained in a polymer binder; a member wherein the binder is present in an amount of from about 50 to about 90 percent by weight, and wherein the total of the layer components is about 100 percent; a photoconductor wherein the photogenerating resinous binder is selected from the group consisting of at least one of polyesters, polyvinyl butyrals, polycarbonates, polystyrene-b-polyvinyl pyridine, and polyvinyl formals; an imaging member wherein the photogenerating component is Type V hydroxygallium phthalocyanine, titanyl phthalocyanine, chlorogallium phthalocyanine, or mixtures thereof, and the charge transport layer contains a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine molecules, and wherein the hole transport resinous binder is selected from the group consisting of polycarbonates and polystyrene; an imaging member wherein the photogenerating layer contains a metal free phthalocyanine; an imaging member wherein the photogenerating layer contains an alkoxygallium phthalocyanine; a photoconductive imaging member with a blocking layer contained as a coating on a substrate, and an adhesive layer coated on the blocking layer; an imaging member further containing an adhesive layer and a hole blocking layer; a color method of imaging which comprises generating an electrostatic latent image on the imaging member, developing the latent image, transferring, and fixing the developed electrostatic image to a suitable substrate; photoconductive imaging members comprised of a supporting substrate, a photogenerating layer, a hole transport layer and a top overcoating layer in contact with the hole transport layer or in embodiments in contact with the photogenerating layer, and in embodiments wherein a plurality of charge transport layers are selected, such as for example, from 2 to about 10, and more specifically, 2 may be selected; and a photoconductive imaging member comprised of an optional supporting substrate, a photogenerating layer, and a first, second, and third charge transport layer.

Examples of POSS molecules, wherein throughout POSS refers to polyhedral oligomeric silsesquioxane, include dodecaphenyl-POSS ($C_{72}H_{60}O_{18}Si_{12}$), octacyclohexyl-POSS ($C_{48}H_{88}O_{12}Si_8$), octaphenyl-POSS ($C_{48}H_{40}O_{12}Si_8$), dodecatrifluoropropyl-POSS ($C_{36}H_{48}F_{36}O_{18}Si_{12}$), phenethylisobutyl-POSS ($C_{36}H_{72}O_{12}Si_8$), and the like, all believed to be commercially available from Hybrid Plastics, Fountain Valley, Calif.

Examples of POSS silanols, wherein throughout POSS refers to polyhedral oligomeric silsesquioxane, include isobutyl-POSS cyclohexenyldimethylsilyldisilanol or isobutyl-polyhedral oligomeric silsesquioxane cyclohexenyldimethylsilyldisilanol ($C_{38}H_{84}O_{12}Si_8$), cyclopentyl-POSS dimethylphenyidisilanol ($C_{43}H_{76}O_{12}Si_8$), cyclohexyl-POSS dimethylvinyldisilanol ($C_{46}H_{88}O_{12}Si_8$), cyclopentyl-POSS dimethylvinyidisilanol ($C_{39}H_{74}O_{12}Si_8$), isobutyl-POSS dimethylvinyldisilanol ($C_{32}H_{74}O_{12}Si_8$), cyclopentyl-POSS disilanol ($C_{40}H_{74}O_{13}Si_8$), isobutyl-POSS disilanol ($C_{32}H_{74}O_{13}Si_8$), isobutyl-POSS epoxycyclohexyldisilanol ($C_{38}H_{84}O_{13}Si_8$), cyclopentyl-POSS fluoro(3)disilanol ($C_{40}H_{75}F_3O_{12}Si_8$), cyclopentyl-POSS fluoro(13)disilanol ($C_{45}H_{75}F_{13}O_{12}Si_8$), isobutyl-POSS fluoro(13)disilanol ($C_{38}H_{75}F_{13}O_{12}Si_8$), cyclohexyl-POSS methacryldisilanol ($C_{51}H_{96}O_{14}Si_8$), cyclopentyl-POSS methacryldisilanol ($C_{44}H_{82}O_{14}Si_8$), isobutyl-POSS methacryldisilanol ($C_{37}H_{82}O_{14}Si_8$), cyclohexyl-POSS monosilanol ($C_{42}H_{78}O_{13}Si_8$), cyclopentyl-POSS monosilanol (Schwabinol, $C_{35}H_{64}O_{13}Si_8$), isobutyl-POSS monosilanol ($C_{28}H_{64}O_{13}Si_8$), cyclohexyl-POSS norbornenylethyldisilanol ($C_{53}H_{98}O_{12}Si_8$), cyclopentyl-POSS norbornenylethyidisilanol ($C_{46}H_{84}O_{12}Si_8$), isobutyl-POSS norbornenylethyidisilanol ($C_{39}H_{84}O_{12}Si_8$), cyclohexyl-POSS TMS disilanol ($C_{45}H_{88}O_{12}Si_8$), isobutyl-POSS TMS disilanol ($C_{31}H_{74}O_{12}Si_8$), cyclohexyl-POSS trisilanol ($C_{42}H_{80}O_{12}Si_7$), cyclopentyl-POSS trisilanol ($C_{35}H_{66}O_{12}Si_7$), isobutyl-POSS trisilanol ($C_{28}H_{66}O_{12}Si_7$), isooctyl-POSS trisilanol ($C_{56}H_{122}O_{12}Si_7$), phenyl-POSS trisilanol ($C_{42}H_{38}O_{12}Si_7$), and the like, all believed to be commercially available from Hybrid Plastics, Fountain Valley, Calif.; examples of POSS olefins include allylcyclohexyl-POSS ($C_{45}H_{82}O_{12}Si_8$), cyclohexenylethylcyclopentyl-POSS ($C_{43}H_{76}O_{12}Si_8$), monovinylcyclohexyl-POSS ($C_{44}H_{80}O_{12}Si_8$), octavinyl-POSS ($C_{16}H_{24}O_{12}Si_8$), octavinyldimethylsilyl-POSS ($C_{32}H_{72}O_{20}Si_{16}$), and the like, all believed to be commercially available from Hybrid Plastics, Fountain Valley, Calif.; examples of POSS alcohols, thiols and phenols wherein POSS refers to polyhedral oligomeric silsesquioxane include trans-cyclohexanediolisobutyl-POSS ($C_{36}H_{78}O_{14}Si_8$), octahydroxypropyldimethylsilyl-POSS ($C_{40}H_{104}O_{28}Si_{16}$), mercaptopropylisooctyl-POSS ($C_{59}H_{126}O_{12}SSi_8$), and the like, all believed to be commercially available from Hybrid Plastics, Fountain Valley, Calif.; examples of POSS alkoxysilanes, chlorosilanes, and silanes, wherein POSS refers to polyhedral oligomeric silsesquioxane, include diethoxymethylsilylethylcyclohexyl-POSS ($C_{49}H_{94}O_{14}Si_9$), triethoxysilylethylcyclohexyl-POSS ($C_{50}H_{96}O_{15}Si_9$), monochlorocyclohexyl-POSS ($C_{42}H_{77}ClO_{12}Si_8$), chlorodimethylsilylethylcyclohexyl-POSS ($C_{46}H_{87}ClO_{12}Si_9$), trichlorosilylethylcyclohexyl-POSS ($C_{44}H_{81}Cl_3O_{12}Si_9$), octa(chlorosilylethyl)-POSS ($C_{32}H_{80}Cl_8O_{12}Si_{16}$), octasilane-POSS ($C_{16}H_{56}O_{20}Si_{16}$), tris(dimethylsilane) cyclohexyl-POSS ($C_{48}H_{98}O_{12}Si_{10}$), and the like, all believed to be commercially available from Hybrid Plastics, Fountain Valley, Calif.; examples of POSS amines, wherein POSS refers to polyhedral oligomeric silsesquioxane, include aminopropylcyclohexyl-POSS ($C_{45}H_{85}NO_{12}Si_8$), aminoethylaminopropylcyclohexyl-POSS ($C_{47}H_{90}N_2O_{12}Si_8$), octaammonium-POSS ($C_{24}H_{72}Cl_8N_8O_{12}Si_8$), and the like, all commercially available from Hybrid Plastics, Fountain Valley, Calif.; examples of POSS epoxides, wherein POSS refers to polyhedral oligomeric silsesquioxane, include epoxycyclohexylcyclohexyl-POSS ($C_{50}H_{90}O_{13}Si_8$), glycidylcyclohexyl-POSS ($C_{48}H_{88}O_{14}Si_8$), octaglycidyldimethylsilyl-POSS ($C_{56}H_{120}O_{36}Si_{16}$), trisglycidylethy-POSS ($C_{59}H_{114}O_{18}Si_{10}$), and the like, all believed to be commercially available from Hybrid Plastics, Fountain Valley, Calif.; examples of POSS esters, wherein throughout POSS refers to polyhedral oligomeric silsesquioxane, include ethylundecanoateisobutyl-POSS ($C_{41}H_{88}O_{14}Si_8$), methylpropionateisobutyl-POSS ($C_{32}H_{70}O_{14}Si_8$), and the like, all believed to be commercially available from Hybrid Plastics, Fountain Valley, Calif.; examples of fluoroalkyl POSS, wherein POSS refers to polyhedral oligomeric silsesquioxane, include fluoro(3)disilanolcyclopentyl-POSS ($C_{40}H_{75}F_3O_{12}Si_8$), fluoro(13)disilanolisobutyl-POSS ($C_{38}H_{75}F_{13}O_{12}Si_8$), dodecatrifluoropropyl-POSS ($C_{36}H_{48}F_{36}O_{18}Si_{12}$), trifluorocyclohexyl-POSS ($C_{42}H_{77}F_3O_9Si_7$), trifluoropropylisobutyl-POSS ($C_{31}H_{67}F_3O_{12}Si_8$), and the commercially available from Hybrid Plastics, Fountain Valley, Calif.; examples of POSS halides, wherein POSS refers to polyhedral oligomeric silsesquioxane, include chlorobenzylcyclohexyl-POSS ($C_{49}H_{83}ClO_{12}Si_8$), chlorobenzylethylcyclopentyl-POSS ($C_{44}H_{73}ClO_{12}Si_8$), chloropropylisobutyl-POSS ($C_{31}H_{69}ClO_{12}Si_8$), and the like, all commercially available from Hybrid Plastics, Fountain Valley, Calif.; examples of POSS isocyanates, wherein POSS refers to polyhedral oligomeric silsesquioxane, include isocyanatopropyl dimethylsilylcyclohexyl-POSS ($C_{48}H_{89}NO_{14}Si_9$), and the like, all believed to be commercially available from Hybrid Plastics, Fountain Valley, Calif.

POSS methacrylates and acrylates examples include acrylocyclohexyl-POSS ($C_{48}H_{86}O_{14}Si_8$), methacrylcyclopentyl-POSS ($C_{42}H_{74}O_{14}Si_8$), trismethacrylcyclohexyl-POSS ($C_{69}H_{128}O_{18}Si_{10}$), and the like, all believed to be commercially available from Hybrid Plastics, Fountain Valley, Calif.; POSS nitriles include cyanoethylcyclohexyl-POSS ($C_{45}H_{81}NO_{12}Si_8$), cyanopropylcyclopentyl-POSS ($C_{39}H_{69}NO_{12}Si_8$), and the like, all believed to be commercially available from Hybrid Plastics, Fountain Valley, Calif.; examples of norbornenyl POSS, wherein POSS refers to polyhedral oligomeric silsesquioxane, include norbornenylethylcyclohexyl-POSS ($C_{51}H_{90}O_{12}Si_8$), trisnorbornenylcyclopentyl-POSS ($C_{68}H_{120}O_{12}Si_{10}$), and the like, all believed to be commercially available from Hybrid Plastics, Fountain Valley, Calif.; examples of POSS phosphines, wherein throughout POSS refers to polyhedral oligomeric silsesquioxane, include diphenylphosphinoethylcyclopentyl-POSS ($C_{49}H_{77}O_{12}PSi_8$), diphenylphosphinopropylcyclopentyl-POSS ($C_{50}H_{79}O_{12}PSi_8$), and the like, all believed to be commercially available from Hybrid Plastics, Fountain Valley, Calif.; and examples of POSS-containing polymers, wherein throughout POSS refers to polyhedral oligomeric silsesquioxane, include poly(dimethyl-co-methylhydrido-co-methylpropyl-POSS)siloxane, poly(dimethyl-co-methylvinyl-co-methylethylsiloxy-POSS)siloxane, poly(ethylsilsesquioxane), poly(methylsilsesquioxane), poly(phenylsilsesquioxane), poly(propylmethacryl-POSS-co-methyl methacrylate), poly(propylmethacryl-POSS-co-styrene), poly(styryl-POSS-co-styrene), poly(vinylsilsesquioxane), and the like, all believed to be commercially available from Hybrid Plastics, Fountain Valley, Calif.

While not being desired to be limited by theory, the POSS-containing materials, it is believed, are thermally and chemically more robust than silicones, and their nano structured shape and size provide unique properties by controlling polymeric chain motion at the molecular level. Also, the POSS-containing materials possess a robust Si—O core surrounded by hydrocarbon chains, which permit the inorganic core to be compatible with an organic matrix $(RSiO_{1.5})_n$ structure, wherein R is a hydrocarbon chain with, for example, from about 2 to about 30 carbon atoms, and n is, for example, 8, 10, or 12.

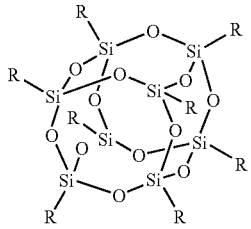

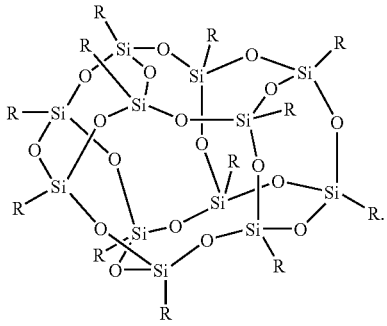

The R groups can be identical or different within one molecule, and can be selected, for example, from the group consisting of at least one of vinyl, cyclopentyl, isobutyl, cyclohexyl, isooctyl, ethyl, phenyl, trifluoropropyl, phenethyl, mixtures thereof, and the like. The R group, for example, allows the POSS to be compounded into standard polymers thereby yielding nanocomposites with a substantially complete molecular level dispersion. The unique ability of POSS to be dispersed at the molecular level reinforces the polymer segments and coils. In embodiments, amount levels for POSS in polymers of up to about 50 weight percent are attainable without negatively impacting the material's physical properties (viscosity, optical clarity, mechanicals) or forcing significant changes in processing conditions. The POSS materials act as reinforcing agents in an organic matrix permitting the enhancement of a variety of properties ($T_g$, hardness, modulus).

The POSS olefins, such as vinyl POSS, are, for example

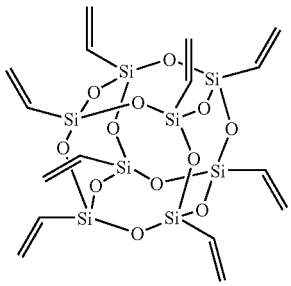

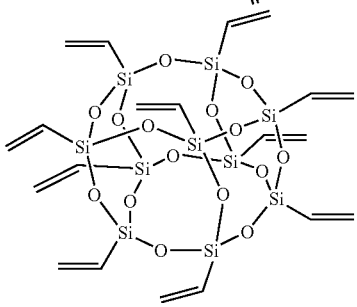

Various suitable amounts of the POSS-containing materials can be selected, such as from about 0.01 to about 50 percent by weight of solids throughout, from about 1 to about 30 percent by weight, or from about 5 to about 20 percent by weight. The POSS-containing materials can be dissolved in the charge transport layer solution, or alternatively the POSS-containing materials can simply be added and dispersed in the formed charge transport layer solution.

The thickness of the substrate layer depends on many factors, including economical considerations, electrical characteristics, and the like, thus this layer may be of substantial thickness, for example over 3,000 microns, such as from about 1,000 to about 3,500, from about 1,000 to about 2,000, from about 300 to about 700 microns, or of a minimum thickness of, for example, about 100 to about 500 microns. In embodiments, the thickness of this layer is from about 75 microns to about 300 microns, or from about 100 microns to about 150 microns.

The substrate may be opaque or substantially transparent, and may comprise any suitable material. Accordingly, the substrate may comprise a layer of an electrically nonconductive or conductive material, such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum, this layer may be of substantial thickness of, for example, up to many centimeters, or of a minimum thickness of less than a millimeter. Similarly, a flexible belt may be of substantial thickness of, for example, about 250 micrometers, or of minimum thickness of less than about 50 micrometers, provided there are no adverse effects on the final electrophotographic device. In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, layers selected for the imaging members of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The photogenerating layer in embodiments is comprised of a number of known photogenerating pigments, such as for example, about 50 weight percent of Type V hydroxygallium phthalocyanine, titanyl phthalocyanine or chlorogallium phthalocyanine, and about 50 weight percent of a resin binder like poly(vinyl chloride-co-vinyl acetate) copolymer, such as VMCH (available from Dow Chemical), or polycarbonate. Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo) perylene, titanyl phthalocyanines, and the like, and more specifically, vanadyl phthalocyanines, Type V hydroxygallium phthalocyanines, and inorganic components, such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers, and the amount of photogenerating material contained in the photogenerating layer. Accordingly, this layer can be of a thickness of, for example, from about 0.05 micron to about 10 microns, and more specifically, from about 0.25 micron to about 2 microns when, for example, the photogenerating compositions are present in an amount of from about 30 to about 75 percent by volume. The maximum thickness of this layer in embodiments is dependent primarily upon factors, such as photosensitivity, electrical properties, and mechanical considerations. The photogenerating layer binder resin is present in various suitable amounts, for example from about 1 to about 50 weight percent, and more specifically, from about 1 to about 10 weight percent, and which resin may be selected from a number of known polymers, such as poly (vinyl butyral), poly(vinyl carbazole), polyesters, polycarbonates, polyarylates, poly(vinyl chloride), polyacrylates and methacrylates, copolymers of vinyl chloride and vinyl acetate, phenolic resins, polyurethanes, poly(vinyl alcohol), polyacrylonitrile, polystyrene, other known suitable binders, and the like. It is desirable to select a coating solvent that does not substantially disturb or adversely affect the previously coated layers of the device. Examples of coating solvents for the photogenerating layer are ketones, alcohols, aromatic hydrocarbons, halogenated aliphatic hydrocarbons, silanols, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, dichloroethane, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium, and the like; hydrogenated amorphous silicon; and compounds of silicon and germanium, carbon, oxygen, nitrogen, and the like fabricated by vacuum evaporation or deposition. The photogenerating layers may also comprise inorganic pigments of crystalline selenium and its alloys; Group II to VI compounds; and organic pigments, such as quinacridones, polycyclic pigments, such as dibromo anthanthrone pigments, perylene and perinone diamines, polynuclear aromatic quinones, azo pigments including bis-, tris- and tetrakis-azos; and the like dispersed in a film forming polymeric binder, and fabricated by solvent coating techniques.

Infrared sensitivity can be desired for photoreceptors exposed to low cost semiconductor laser diode light exposure devices where, for example, the absorption spectrum and photosensitivity of the phthalocyanines selected depend on the central metal atom thereof. Examples of these phthalocyanines selected for the photogenerating layer of the photoconductors of the present disclosure include oxyvanadium phthalocyanine, chloroaluminum phthalocyanine, copper phthalocyanine, oxytitanium phthalocyanine, chlorogallium phthalocyanine, hydroxygallium phthalocyanine, magnesium phthalocyanine, and metal free phthalocyanine. The phthalocyanines exist in many crystal forms, and have a strong influence on photogeneration.

In embodiments, examples of polymeric binder materials that can be selected as the matrix for the photogenerating layer are illustrated in U.S. Pat. No. 3,121,006, the disclosure of which is totally incorporated herein by reference. Specific examples of binders are thermoplastic and thermosetting resins, such as polycarbonates, polyesters, polyamides, polyurethanes, polystyrenes, polyarylsilanols, polyarylsulfones, polybutadienes, polysulfones, polysilanolsulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrene butadiene copolymers, vinylidene chloride-vinyl chloride copolymers, vinyl acetate-vinylidene chloride copolymers, styrene-alkyd resins, poly(vinyl carbazole), and the like. These polymers may be block, random, or alternating copolymers.

The photogenerating composition or pigment is present in the resinous binder composition in various amounts. Generally, however, from about 5 percent by weight to about 90 percent by weight of the photogenerating pigment is dispersed in about 10 percent by weight to about 95 percent by weight of the resinous binder, or from about 20 percent by weight to about 50 percent by weight of the photogenerating pigment is dispersed in about 80 percent by weight to about 50 percent by weight of the resinous binder composition. In one embodiment, about 50 percent by weight of the photogenerating pigment is dispersed in about 50 percent by weight of the resinous binder composition.

Various suitable and conventional known processes may be used to mix, and thereafter apply the photogenerating layer coating mixture like spraying, dip coating, roll coating, wire wound rod coating, vacuum sublimation, and the like. For some applications, the photogenerating layer may be fabricated in a dot or line pattern. Removal of the solvent of a solvent-coated photogenerating layer may be effected by any known conventional techniques such as oven drying, infrared radiation drying, air drying, and the like.

The coating of the photogenerating layer in embodiments of the present disclosure can be accomplished to achieve a final dry thickness of the photogenerating layer as illustrated herein, and for example, from about 0.01 to about 30 microns after being dried at, for example, about 40° C. to about 150° C. for about 1 to about 90 minutes. More specifically, a photogenerating layer of a thickness, for example, of from about 0.1 to about 30 microns, or from about 0.5 to about 2 microns can be applied to or deposited on the substrate, on other surfaces in between the substrate and the charge transport layer, and the like. A charge blocking layer or hole blocking layer may optionally be applied to the electrically conductive surface prior to the application of a photogenerating layer. When desired, an adhesive layer may be included between the charge blocking, hole blocking layer, or interfacial layer, and the photogenerating layer. Usually, the photogenerating layer is applied onto the blocking layer, and a charge transport layer or plurality of charge transport layers are formed on the photogenerating layer. The photogenerating layer may be applied on top of or below the charge transport layer.

In embodiments, a suitable known adhesive layer can be included in the photoconductor. Typical adhesive layer materials include, for example, polyesters, polyurethanes, and the like. The adhesive layer thickness can vary and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying and the like.

As optional adhesive layers usually in contact with or situated between the hole blocking layer and the photogenerating layer, there can be selected various known substances inclusive of copolyesters, polyamides, poly(vinyl butyral), poly (vinyl alcohol), polyurethane, and polyacrylonitrile. This layer is, for example, of a thickness of from about 0.001 micron to about 1 micron, or from about 0.1 micron to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

The optional hole blocking or undercoat layers for the imaging members of the present disclosure can contain a number of components including known hole blocking components, such as amino silanes, doped metal oxides, TiSi, a metal oxide like titanium, chromium, zinc, tin and the like; a mixture of phenolic compounds and a phenolic resin, or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene) bisphenol), P (4,4'-(1,4-phenylene diisopropylidene) bisphenol), S (4,4'-sulfonyldiphenol), and Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of a suitable component like a metal oxide, such as $TiO_2$; from about 20 weight percent to about 70 weight percent, and more specifically, from about 25 weight percent to about 50 weight percent of a phenolic resin; from about 2 weight percent to about 20 weight percent, and more specifically, from about 5 weight percent to about 15 weight percent of a phenolic compound containing, for example, at least two phenolic groups, such as bisphenol S; and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9 nanometers. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM® 29159 and 29101 (available from OxyChem Company), and DURITE® 97 (available from Borden Chemical); formaldehyde polymers with ammonia, cresol and phenol, such as VARCUM® 29112 (available from OxyChem Company); formaldehyde polymers with 4,4'-(1-methylethylidene) bisphenol, such as VARCUM® 29108 and 29116 (available from OxyChem Company); formaldehyde polymers with cresol and phenol, such as VARCUM® 29457 (available from OxyChem Company), DURITE® SD-423A, SD-422A (available from Borden Chemical); or formaldehyde polymers with phenol and p-tert-butylphenol, such as DURITE® ESD 556C (available from Borden Chemical).

Charge transport layer components and molecules include a number of known materials as illustrated herein, such as aryl amines, which layer is generally of a thickness of from about 5 microns to about 75 microns, and more specifically, of a thickness of from about 10 microns to about 40 microns. Examples of charge transport layer components include

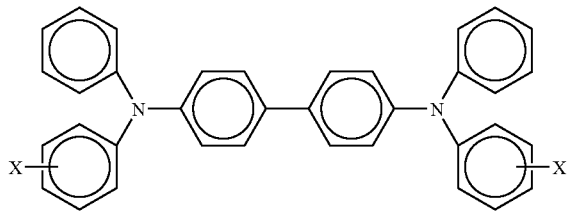

wherein X is alkyl, alkoxy, aryl, a halogen, or mixtures thereof, and especially those substituents selected from the group consisting of Cl and $CH_3$; and molecules of the following formula

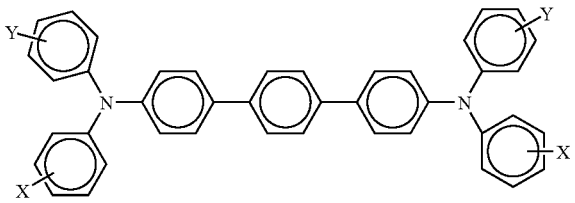

wherein X and Y are independently alkyl, alkoxy, aryl, a halogen, or mixtures thereof.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide and fluoride. Substituted alkyls, alkoxys, and aryls can also be selected in embodiments.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis (halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N, N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules can be selected, reference for example, U.S. Pat. Nos. 4,921,773 and 4,464,450, the disclosures of which are totally incorporated herein by reference.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly (4,4'-isopropylidene-diphenylene)carbonate (also referred to as bisphenol-A-polycarbonate), poly(4,4'-cyclohexylidine-diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, the charge transport layer binders are comprised of polycarbonate resins with a weight average molecular weight of from about 20,000 to about 100,000, or with a molecular weight $M_w$ of from about 50,000 to about 100,000 preferred. Generally, in embodiments the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule and silanol are dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of hole transporting molecules, especially for the first and second charge transport layers, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N, N'-di-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl)carbazyl hydrazone, and 4-diethyl amino benzaldehyde-1,2-diphenyl hydrazone; and oxadiazoles, such as 2,5-bis(4-N,N'-diethylaminophenyl)-1,2,4-oxadiazole, stilbenes, and the like. However, in embodiments to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency, and transports them across the charge transport layer with short transit times, and which layer contains a binder and a silanol includes N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. If desired, the charge transport material in the charge transport layer may comprise a polymeric charge transport material, or a combination of a small molecule charge transport material and a polymeric charge transport material.

The thickness of each of the charge transport layers in embodiments is from about 5 to about 75 microns, but thicknesses outside this range may in embodiments also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported through itself to selectively discharge a surface charge on the surface of the active layer.

The thickness of the continuous charge transport overcoat layer selected depends upon the abrasiveness of the charging (bias charging roll), cleaning (blade or web), development (brush), transfer (bias transfer roll), and the like in the system employed, and can be up to about 10 micrometers. In embodiments, this thickness for each layer is from about 1 micrometer to about 5 micrometers. Various suitable and conventional methods may be used to mix, and thereafter apply the overcoat layer coating mixture to the photoconductor. Typical application techniques include spraying, dip coating, roll coating, wire wound rod coating, and the like. Drying of the deposited coating may be effected by any suitable conventional technique, such as oven drying, infrared radiation drying, air drying, and the like. The dried overcoating layer of this disclosure should transport holes during imaging and should not have too high a free carrier concentration.

The overcoat can comprise the same components as the charge transport layer wherein the weight ratio between the charge transporting small molecules, and the suitable electrically inactive resin binder is, for example, from about 0/100 to about 60/40, or from about 20/80 to about 40/60.

Examples of components or materials optionally incorporated into the charge transport layers or at least one charge transport layer to, for example, enable improved lateral charge migration (LCM) resistance include hindered phenolic antioxidants, such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Company, Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Company, Ltd.); hindered amine antioxidants such as SANOL™ LS-2626, LS-765, LS-770 and LS-744 (available from SNKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules, such as bis(4-diethylamino-2-methylphenyl) phenylmethane (BDETPM), bis-[2-methyl-4-(N-2-hydroxyethyl-N-ethyl-aminophenyl)]-phenylmethane (DHTPM), and the like. The weight percent of the antioxidant in at least one of the charge transport layers is from about 0 to about 20, from about 1 to about 10, or from about 3 to about 8 weight percent.

Primarily for purposes of brevity, the examples of each of the substituents, and each of the components/compounds/molecules, polymers, (components) for each of the layers, specifically disclosed herein are not intended to be exhaustive. Thus, a number of components, polymers, formulas, structures, and R group or substituent examples, and carbon chain lengths not specifically disclosed or claimed are intended to be encompassed by the present disclosure and claims. Also, the carbon chain lengths are intended to include all numbers between those disclosed or claimed or envisioned, thus from 1 to about 20 carbon atoms, and from 6 to about 36 carbon atoms includes 1, 2, 3, 4, 5, 6, 7, 8, 9, 10, 11, 12, 13, 14, 15, up to 36, or more. At least one refers, for example, to from 1 to about 5, from 1 to about 2, 1, 2, and the like; and in embodiments, the thiophosphate and/or POSS may be present in the photogenerating and charge transport layers in various suitable combinations. Similarly, the thickness of each of the layers, the examples of components in each of the layers, the amount ranges of each of the components disclosed and claimed is not exhaustive, and it is intended that the present disclosure and claims encompass other suitable parameters not disclosed or that may be envisioned.

The following Examples are being submitted to illustrate embodiments of the present disclosure. These Examples are intended to be illustrative only, and are not intended to limit the scope of the present disclosure. Also, parts and percentages are by weight unless otherwise indicated. A Comparative Example and data are also provided.

Comparative Example 1

An imaging member was prepared by providing a 0.02 micrometer thick titanium layer coated (coater device used) on a biaxially oriented polyethylene naphthalate substrate (KALEDEX™ 2000) having a thickness of 3.5 mils, and applying thereon, with a gravure applicator, a solution containing 50 grams of 3-amino-propyltriethoxysilane, 41.2 grams of water, 15 grams of acetic acid, 684.8 grams of denatured alcohol, and 200 grams of heptane. This layer was then dried for about 5 minutes at 135° C. in the forced air dryer of the coater. The resulting blocking layer had a dry thickness of 500 Angstroms. An adhesive layer was then prepared by applying a wet coating over the blocking layer using a gravure applicator, and which adhesive layer contained 0.2 percent by weight based on the total weight of the solution of the copolyester adhesive (ARDEL™ D100 available from Toyota Hsutsu Inc.) in a 60:30:10 volume ratio mixture of tetrahydrofuran/monochlorobenzene/methylene chloride. The adhesive layer was then dried for about 5 minutes at 135° C. in the forced air dryer of the coater. The resulting adhesive layer had a dry thickness of 200 Angstroms.

A photogenerating layer dispersion was prepared by introducing 0.45 grams of the known polycarbonate LUPILON™ 200 (PCZ-200) or POLYCARBONATE Z™, weight average molecular weight of 20,000, available from Mitsubishi Gas Chemical Corporation, and 50 milliliters of tetrahydrofuran into a 4 ounce glass bottle. To this solution were added 2.4 grams of hydroxygallium phthalocyanine (Type V), and 300 grams of ⅛ inch (3.2 millimeters) diameter stainless steel shot. The resulting mixture was then placed on a ball mill for 8 hours. Subsequently, 2.25 grams of PCZ-200 were dissolved in 46.1 grams of tetrahydrofuran, and added to the hydroxygallium phthalocyanine dispersion. The obtained slurry was then placed on a shaker for 10 minutes. The resulting dispersion was, thereafter, applied to the above adhesive interface with a Bird applicator to form a photogenerating layer having a wet thickness of 0.25 mil. A strip about 10 millimeters wide along one edge of the substrate web bearing the blocking layer and the adhesive layer was deliberately left uncoated by any of the photogenerating layer material to facilitate adequate electrical contact by the ground strip layer that was applied later. The photogenerating layer was dried at 120° C. for 1 minute in a forced air oven to form a dry photogenerating layer having a thickness of 0.4 micrometer.

The resulting imaging member web was then overcoated with two charge transport layers. Specifically, the photogenerating layer was overcoated with a charge transport layer (the bottom layer) in contact with the photogenerating layer. The bottom layer of the charge transport layer was prepared by introducing into an amber glass bottle in a weight ratio of 1:1 N,N'-diphenyl-N,N'-bis(3-methylphenyl)-1,1'-biphenyl-4,4'-diamine and MAKROLON® 5705, a known polycarbonate resin having a molecular weight average of from about 50,000 to about 100,000, commercially available from Farbenfabriken Bayer A. G. The resulting mixture was then dissolved in methylene chloride to form a solution containing 15 percent by weight solids. This solution was applied on the photogenerating layer to form the bottom layer coating that upon drying (120° C. for 1 minute) had a thickness of 14.5 microns. During this coating process, the humidity was equal to or less than 15 percent.

The bottom layer of the charge transport layer was then overcoated with a top layer. The charge transport layer solution of the top layer was prepared as described above for the bottom layer. The top layer solution was applied on the bottom layer of the charge transport layer to form a coating that upon drying (120° C. for 1 minute) had a thickness of 14.5 microns. During this coating process, the humidity was equal to or less than 15 percent.

Example I

An imaging or photoconductive member was prepared by repeating the process of Comparative Example 1 except that the top layer of the charge transport layer was prepared by introducing into an amber glass bottle in a weight ratio of 1:1:0.2 N,N'-diphenyl-N,N'-bis(3-methylphenyl)-1,1'-biphenyl-4,4'-diamine, MAKROLON® 5705, a polycarbonate resin having a weight average molecular weight of from about 50,000 to about 100,000, commercially available from Farbenfabriken Bayer A. G., and a vinyl-POSS cage mixture, OL1170™, $(CH_2CH)_nT_n$, n=8, 10, 12, available from Hybrid Plastics, Fountain Valley, Calif. The vinyl-POSS structure containing $(RsiO_{1.5})_n$ where n is equal to 10 is believed to be

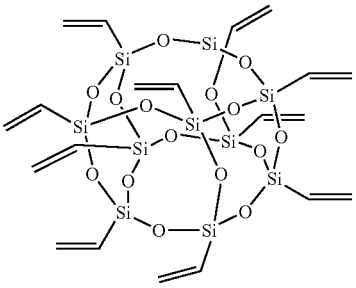

The resulting mixture was dissolved in methylene chloride to form a solution containing 15 percent by weight solids.

Example II

An imaging member was prepared by repeating the process of Comparative Example 1 except that (1) the top layer of the charge transport layer was prepared by introducing into an amber glass bottle in a weight ratio of 0.8:1:0.2 N,N'-diphenyl-N,N'-bis(3-methylphenyl)-1,1'-biphenyl-4,4'-diamine, MAKROLON® 5705, a polycarbonate resin having a weight average molecular weight of from about 50,000 to about 100,000, commercially available from Farbenfabriken Bayer A. G., and vinyl-POSS cage mixture, OL1170™, $(CH_2CH)_n T_n$, n=8, 10, 12, available from Hybrid Plastics, Fountain Valley, Calif. The resulting mixture was dissolved in methylene chloride to form a solution containing 15 percent by weight solids; (2) to the photogenerating layer dispersion was added 0.48 gram of zinc dialkyldithiophosphate (ELCO™ 103, wherein alkyl is a mixture of primary and secondary propyl, butyl and pentyl), commercially available from Elco Corporation, Cleveland, Ohio, and the resulting dispersion was allowed to mix for at least 2 hours.

Example III

An imaging member was prepared by repeating the process of Comparative Example 1 except that (1) the top layer of the charge transport layer was prepared by introducing into an amber glass bottle in a weight ratio of 0.8:1:0.2 N,N'-diphenyl-N,N'-bis(3-methylphenyl)-1,1'-biphenyl-4,4'-diamine, MAKROLON® 5705, a polycarbonate resin having a weight average molecular weight of from about 50,000 to about 100,000, commercially available from Farbenfabriken Bayer A. G., and for scratch resistance vinyl-POSS cage mixture, OL1170™, $(CH_2CH)_nT_n$, n=8, 10, 12, available from Hybrid Plastics, Fountain Valley, Calif. The resulting mixture was dissolved in methylene chloride to form a solution containing 15 percent by weight solids; (2) the bottom layer of the charge transport layer was prepared by introducing into an amber glass bottle in a weight ratio of 1:1:0.01 N,N'-diphenyl-N,N'-bis(3-methylphenyl)-1,1'-biphenyl-4,4'-diamine, MAKROLON® 5705, a polycarbonate resin having a weight average molecular weight of from about 50,000 to about 100,000, commercially available from Farbenfabriken Bayer A. G., and zinc dialkyldithiophosphate (ELCO™ 103, wherein alkyl is a mixture of primary and secondary propyl, butyl and pentyl), commercially available from Elco Corporation, Cleveland, Ohio. The resulting mixture was dissolved in methylene chloride to form a solution containing 15 percent by weight solids; and (3) to the photogenerating layer dispersion was added 0.24 grams of zinc dialkyldithiophosphate (ELCO™ 103, wherein alkyl is a mixture of primary and secondary propyl, butyl and pentyl), which ELCO™ provided, for example, excellent photoconductor electricals of lower $V_r$ and prevention or minimization of $V_r$ cycle up, commercially available from Elco Corporation, Cleveland, Ohio, and the resulting dispersion was allowed to mix for at least 2 hours.

Electrical Property Testing

The above prepared photoreceptor devices (Comparative Example 1 and Examples I, II, III) were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities are measured. Additional electrical characteristics were obtained by a series of charge-erase cycles with incrementing surface potential to generate several voltage versus charge density curves. The scanner was equipped with a scorotron set to a constant voltage charging at various surface potentials. The devices were tested at surface potentials of 500 volts with the exposure light intensity incrementally increased by means of regulating a series of neutral density filters; the exposure light source was a 780 nanometer light emitting diode. The xerographic simulation was completed in an environmentally controlled light tight chamber at ambient conditions (40 percent relative humidity and 22° C.). The devices were also cycled to 10,000 cycles electrically with charge-discharge-erase. Eight photoinduced discharge characteristic (PIDC) curves were generated, one for each of the above prepared photoconductors at both cycle=0 and cycle=10,000, and where V equals volt. The results are summarized in Table 1.

TABLE 1

| | V (3.5 ergs/cm$^2$) (V) | |
|---|---|---|
| | Cycle = 0 | Cycle = 10,000 |
| Comparative Example 1 | 59 | 114 |
| Example I | 75 | 138 |
| Example II | 65 | 70 |
| Example III | 60 | 66 |

There is illustrated by the above Table 1 data a number of improved characteristics for the Example I, II and III photoconductive members as determined by the generation of known PIDC curves. More specifically, V (3.5 ergs/cm$^2$) in Table 1 represents the surface potential of the photoconductor devices when exposure is 3.5 ergs/cm$^2$, and is used to characterize the PIDC. Incorporation of the POSS-containing material into the charge transport layer (Example I) increased V (3.5 ergs/cm$^2$) at cycle=0, and scratch resistance was improved as illustrated below in the scratch resistance testing.

After 10,000 cycles, the cycle up of Example I was comparable to that of the Comparative Example 1, which indicated that the incorporation of the POSS-containing material had little effect on cycle up. Therefore, incorporation of only the POSS-containing material into the charge transport layer resulted in a somewhat less than desirable PIDC (higher $V_r$), and scratch resistance was improved as illustrated below in the scratch resistance testing.

Incorporation of both the POSS-containing material into the charge transport layer and the thiophosphate into the photogenerating layer and the charge transport layers enabled a scratch resistant imaging member with excellent electrical properties. More specifically, V (3.5 ergs/cm$^2$) at cycle=0 of these members was comparable to that of the Comparative Example 1, and there was almost no cycle up after 10,000 cycles as compared to the Comparative Example 1 number.

Scratch Resistance Testing $R_q$, which represents the surface roughness, can be considered the root mean square roughness as the standard metric for the scratch resistance assessment with a scratch resistance of grade 1 representing poor scratch resistance, and a scratch resistance of grade 5 representing excellent scratch resistance as measured by a surface profile meter. More specifically, the scratch resistance is grade 1 when the $R_q$ measurement is greater than 0.3 micron; grade 2 for $R_q$ between 0.2 and 0.3 micron; grade 3 for $R_q$ between 0.15 and 0.2 micron; grade 4 for $R_q$ between 0.1 and 0.15 micron; and grade 5 being the best or excellent scratch resistance when $R_q$ is less than 0.1 micron.

The above prepared four photoconductive belts (Comparative Example 1 and Examples I, II, III) were cut into strips of 1 inch in width by 12 inches in length, and were flexed in a tri-roller flexing system. Each belt was under a 1.1 lb/inch tension, and each roller was ⅛ inch in diameter. A polyurethane "spots blade" was placed in contact with each belt at an angle of between 5 and 15 degrees. Carrier beads of about 100 micrometers in size diameter were attached to the spots blade by the aid of double tape. These beads struck the surface of each of the belts as the photoconductor rotated in contact with the spots blade for 200 simulated imaging cycles. The surface morphology of each scratched area was then analyzed.

Incorporation of the POSS-containing material into the charge transport layer improved scratch resistance by from about 30 percent to about 50 percent.

For example, after the scratch resistance test, the comparative imaging member (Comparative Example 1) with no POSS-containing material had an $R_q$ value of 0.3 micron; the imaging members with the POSS-containing material had an $R_q$ value of from 0.15 to 0.2 micron depending on loading and location of the POSS-containing material (Examples I, II, III); a scratch resistance improvement of from about 30 percent to about 50 percent was realized for the photoconductor of Examples I, II, and III.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. An imaging member comprising an optional supporting substrate, a thiophosphate containing photogenerating layer, and at least one charge transport layer comprised of at least one charge transport component, at least one of a polyhedral oligomeric silsesquioxane (POSS)-containing material, and a thiophosphate.

2. An imaging member in accordance with claim 1 wherein said polyhedral oligomeric silsesquioxane contains a component of $(RSiO_m)_n$ wherein R is at least one of alkyl, alkoxy, and aryl, n is a number of from about 2 to about 30, and m is a number of from about 0.5 to about 2.5.

3. An imaging member in accordance with claim 2 wherein n is from about 5 to about 18, m is from about 1 to about 2, and R represents substituted derivatives of said alkyl, alkoxy and aryl of an alcohol, phenol, thiol, alkoxysilane, amine, chlorosilane, epoxide, ester, fluoroalkyl, halide, isocyanate, methacrylate, acrylate, nitrile, norbornenyl, olefin, phosphine, silane, silanol, styrene, and mixtures thereof.

4. An imaging member in accordance with claim 2 wherein n is 8, 10 or 12, m is 1.5, and said alkyl contains from about 4 to about 18 carbon atoms.

5. An imaging member in accordance with claim 1 wherein said charge transport component is comprised of aryl amine molecules, and which aryl amines are of the formula

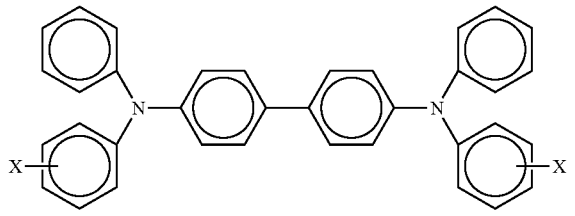

wherein X is selected from the group consisting of alkyl, alkoxy, aryl, and halogen, and mixtures thereof.

6. An imaging member in accordance with claim 5 wherein said alkyl and said alkoxy each contains from about 1 to about 12 carbon atoms, and said aryl contains from about 6 to about 36 carbon atoms; and wherein the photoconductor contains a supporting substrate.

7. An imaging member in accordance with claim 5 wherein said aryl amine is N,N'-diphenyl-N,N-bis(3-methylphenyl)-1,1'-biphenyl-4,4'-diamine.

8. An imaging member in accordance with claim 1 wherein said charge transport component is comprised of aryl amine molecules, and which aryl amines are of the formula

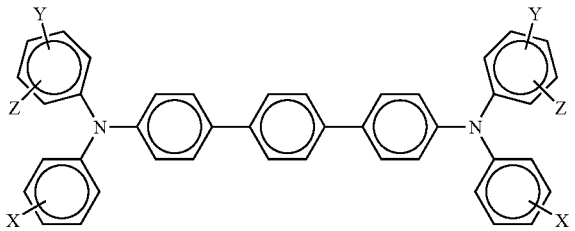

wherein X, Y, and Z are independently selected from the group consisting of alkyl, alkoxy, aryl, and halogen, and mixtures thereof; and wherein at least one of X and Y are present.

9. An imaging member in accordance with claim 8 wherein alkyl and alkoxy each contains from 1 to about 12 carbon atoms, and aryl contains from 6 to about 36 carbon atoms.

10. An imaging member in accordance with claim 8 wherein said aryl amine is selected from at least one of the group consisting of N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine; and wherein said photoconductor further comprises a supporting substrate.

11. An imaging member in accordance with claim 1 wherein said polyhedral oligomeric silsesquioxane and said thiophosphate are each present in at least one charge transport layer in an amount of from about 0.01 to about 40 weight percent, wherein said charge transport layer contains hole transport molecules and a resin binder, and wherein said photogenerating layer contains a photogenerating pigment and a resin binder, and which layer contains from about 0.1 to about 40 weight percent of said thiophosphate.

12. An imaging member in accordance with claim 1 further including in at least one of said charge transport layers an antioxidant comprised of a hindered phenolic, a hindered amine, and mixtures thereof.

13. An imaging member in accordance with claim 1 wherein said photogenerating layer is comprised of a photogenerating pigment or photogenerating pigments, and said thiophosphate and said photoconductor further includes a supporting substrate.

14. An imaging member in accordance with claim 13 wherein said photogenerating pigment is comprised of at least one of a titanyl phthalocyanine, a hydroxygallium phthalocyanine, a halogallium phthalocyanine, a perylene, or mixtures thereof.

15. An imaging member in accordance with claim 13 wherein said photogenerating pigment is comprised of a metal phthalocyanine, a metal free phthalocyanine, or mixtures thereof.

16. An imaging member in accordance with claim 13 wherein said photogenerating pigment is comprised of chlorogallium phthalocyanine.

17. An imaging member in accordance with claim 13 wherein said photogenerating pigment is comprised of hydroxygallium phthalocyanine.

18. An imaging member in accordance with claim 1 further including a hole blocking layer, and an adhesive layer, and wherein said substrate is present.

19. An imaging member in accordance with claim 1 wherein said at least one charge transport layer is from 1 to about 7 layers, and said substrate is present.

20. An imaging member in accordance with claim 1 wherein said at least one charge transport layer is from 1 to about 3 layers.

21. An imaging member in accordance with claim 1 wherein said at least one charge transport layer is comprised of a top charge transport layer and a bottom charge transport layer, and wherein said top layer is in contact with said bottom layer and said bottom layer is in contact with said photogenerating layer, and wherein said photoconductor includes a supporting substrate.

22. An imaging member in accordance with claim 21 wherein said top layer is comprised of a hole transport component, a resin binder, an optional antioxidant, said thiophosphate, and said polyhedral oligomeric silsesquioxane (POSS)-containing material; and said bottom layer is comprised of at least one charge transport component, a resin binder, and an antioxidant.

23. An imaging member in accordance with claim 1 wherein said polyhedral oligomeric silsesquioxane (POSS)-containing material is present in an amount of from about 1 to about 30 weight percent in said charge transport layer.

24. An imaging member in accordance with claim 1 wherein said thiophosphate is present in an amount of from about 0.01 to about 20 weight percent in said charge transport layer, and from about 0.1 to about 40 weight percent in said photogenerating layer, and which thiophosphate is molybdenum di(2-ethylhexyl)dithiophosphate, zinc diethyldithiophosphate, or antimony diamyldithiophosphate.

25. An imaging member in accordance with claim 1 wherein said thiophosphate is

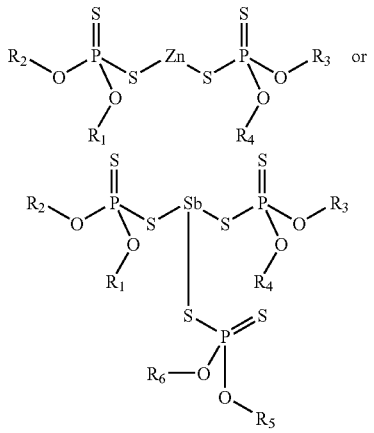

wherein $R_1$, $R_2$, $R_3$, $R_4$, $R_5$ and $R_6$ each independently represents at least one of a hydrogen atom; alkyl, and aryl; and wherein said dialkyldiphosphate and said polyhedral oligomeric silsesquioxane are each present in an amount of from about 0.1 to about 40 weight percent.

26. A photoconductor in accordance with claim 25 wherein $R_1$, $R_2$, $R_3$, $R_4$, $R_5$ and $R_6$ each independently represents alkyl containing from 1 to about 20 carbon atoms; cycloalkyl containing from 6 to about 26 carbon atoms; aryl, alkylaryl, arylalkyl, or mixtures thereof, each containing from about 6 to about 50 carbon atoms.

27. An imaging member in accordance with claim 1 wherein said thiophosphate is present in both the at least one charge transport layer and said photogenerating layer, in an amount of from about 0.1 to about 15, or from about 0.2 to about 5 weight percent; wherein at least one photogenerating layer is from 1 to 2, wherein at least one POSS-containing material and at least one thiophosphate is from 1 to 3; and wherein at least one charge transport layer is 1.

28. A photoconductor comprising a supporting substrate; a thiophosphate containing photogenerating layer; and at least one charge transport layer comprised of a thiophosphate and at least one polyhedral oligomeric silsesquioxane (POSS)-containing material, and wherein said polyhedral oligomeric silsesquioxane (POSS) is selected from the group comprised of at least one of a polyhedral oligomeric silsesquioxane, polyhedral oligomeric silsesquioxane alcohols and phenols, polyhedral oligomeric silsesquioxane alkoxysilanes, polyhedral oligomeric silsesquioxane amines, polyhedral oligomeric silsesquioxane chlorosilanes, polyhedral oligomeric silsesquioxane epoxides, polyhedral oligomeric silsesquioxane esters, fluoroalkyl polyhedral oligomeric silsesquioxane, polyhedral oligomeric silsesquioxane halides, polyhedral oligomeric silsesquioxane isocyanates, polyhedral oligomeric silsesquioxane methacrylates and acrylates, polyhedral oligomeric silsesquioxane nitriles, norbornenyl polyhedral oligomeric silsesquioxane, polyhedral oligomeric silsesquioxane olefins, polyhedral oligomeric silsesquioxane phosphines, polyhedral oligomeric silsesquioxane silanes, polyhedral oligomeric silsesquioxane silanols, polyhedral oligomeric silsesquioxane thiols, polyhedral oligomeric silsesquioxane-containing polymers, and mixtures thereof; and said thiophosphate is

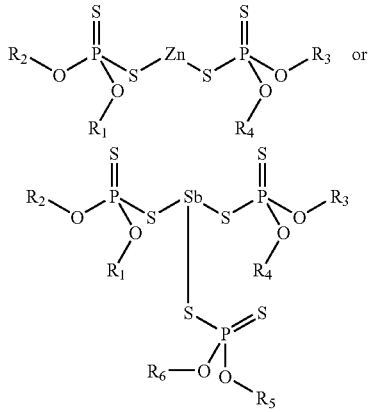

wherein $R_1$, $R_2$, $R_3$, $R_4$, $R_5$ and $R_6$ each independently represents at least one of a hydrogen atom, alkyl, cycloalkyl, aryl, alkylaryl and arylalkyl.

29. A photoconductor in accordance with claim 28 wherein said polyhedral oligomeric silsesquioxane is selected from the group consisting of at least one of dodecaphenyl-POSS ($C_{72}H_{60}O_{18}Si_{12}$), octacyclohexyl-POSS ($C_{48}H_{88}O_{12}Si_8$), octaphenyl-POSS ($C_{48}H_{40}O_{12}Si_8$), dodecatrifluoropropyl-POSS ($C_{36}H_{48}F_{36}O_{18}Si_{12}$), phenethylisobutyl-POSS ($C_{36}H_{72}O_{12}Si_8$), isobutyl-POSS cyclohexenyldimethylsilyldisilanol or isobutyl-polyhedral oligomeric silsesquioxane cyclohexenyldimethylsilyldisilanol ($C_{38}H_{84}O_{12}Si_8$), cyclopentyl-POSS dimethylphenyldisilanol ($C_{43}H_{76}O_{12}Si_8$), cyclohexyl-POSS dimethylvinyldisilanol ($C_{46}H_{88}O_{12}Si_8$), cyclopentyl-POSS dimethylvinyldisilanol ($C_{39}H_{74}O_{12}Si_8$), isobutyl-POSS dimethylvinyldisilanol ($C_{32}H_{74}O_{12}Si_8$), cyclopentyl-POSS disilanol ($C_{40}H_{74}O_{13}Si_8$), isobutyl-POSS disilanol ($C_{32}H_{74}O_{13}Si_8$), isobutyl-POSS epoxycyclohexyldisilanol ($C_{38}H_{84}O_{13}Si_8$), cyclopentyl-POSS fluoro(3)disilanol ($C_{40}H_{75}F_3O_{12}Si_8$), cyclopentyl-POSS fluoro(13)disilanol ($C_{45}H_{75}F_{13}O_{12}Si_8$), isobutyl-POSS fluoro(13)disilanol ($C_{38}H_{75}F_{13}O_{12}Si_8$), cyclohexyl-POSS methacryldisilanol ($C_{51}H_{96}O_{14}Si_8$), cyclopentyl-POSS methacryldisilanol ($C_{44}H_{82}O_{14}Si_8$), isobutyl-POSS methacryldisilanol ($C_{37}H_{82}O_{14}Si_8$), cyclohexyl-POSS monosilanol ($C_{42}H_{78}O_{13}Si_8$), cyclopentyl-POSS monosilanol (Schwabinol, $C_{35}H_{64}O_{13}Si_8$), isobutyl-POSS monosilanol ($C_{28}H_{64}O_{13}Si_8$), cyclohexyl-POSS norbornenylethyldisilanol ($C_{53}H_{98}O_{12}Si_8$), cyclopentyl-POSS norbornenylethyldisilanol ($C_{46}H_{84}O_{12}Si_8$), isobutyl-POSS norbornenylethyldisilanol ($C_{39}H_{84}O_{12}Si_8$), cyclohexyl-POSS TMS disilanol ($C_{45}H_{88}O_{12}Si_8$), isobutyl-POSS TMS disilanol ($C_{31}H_{74}O_{12}Si_8$), cyclohexyl-POSS trisilanol ($C_{42}H_{80}O_{12}Si_7$), cyclopentyl-POSS trisilanol ($C_{35}H_{66}O_{12}Si_7$), isobutyl-POSS trisilanol ($C_2H_{66}O_{12}Si_7$), isooctyl-POSS trisilanol ($C_{56}H_{122}O_{12}Si_7$), phenyl-POSS trisilanol ($C_{42}H_{38}O_{12}Si_7$), allylcyclohexyl-POSS ($C_{45}H_{82}O_{12}Si_8$), cyclohexenylethylcyclopentyl-POSS ($C_{43}H_{76}O_{12}Si_8$), monovinylcyclohexyl-POSS ($C_{44}H_{50}O_{12}Si_8$), octavinyl-POSS ($C_{16}H_{24}O_{12}Si_8$), octavinyldimethylsilyl-POSS ($C_{32}H_{72}O_{20}Si_{16}$), trans-cyclohexanediolisobutyl-POSS ($C_{36}H_{78}O_{14}Si_8$), octahydroxypropyldimethylsilyl-POSS ($C_{40}H_{104}O_{28}Si_{16}$), mercaptopropyl isooctyl-POSS ($C_{59}H_{126}O_{12}SSi_8$), diethoxymethylsilylethylcyclohexyl-POSS ($C_{49}H_{94}O_{14}Si_9$), triethoxysilylethylcyclohexyl-POSS ($C_{50}H_{96}O_{15}Si_9$), monochlorocyclohexyl-POSS ($C_{42}H_{77}ClO_{12}Si_8$), chlorodimethylsilylethyl cyclohexyl-POSS ($C_{46}H_{87}ClO_{12}Si_9$), trichlorosilylethylcyclohexyl-POSS ($C_{44}H_{81}Cl_3O_{12}Si_9$), octa(chlorosilylethyl)-POSS ($C_{32}H_{80}Cl_8O_{12}Si_{16}$), octasilane-POSS ($C_{16}H_{56}O_{20}Si_{16}$), tris(dimethylsilane)cyclohexyl-POSS ($C_{48}H_{98}O_{12}Si_{10}$), aminopropylcyclohexyl-POSS ($C_{45}H_{85}NO_{12}Si_8$), aminoethylaminopropyl cyclohexyl-POSS ($C_{47}H_{90}N_2O_{12}Si_8$), octaammonium-POSS ($C_{24}H_{72}Cl_8N_8O_{12}Si_8$), epoxycyclohexylcyclohexyl-POSS ($C_{50}H_{90}O_{13}Si_8$), glycidylcyclohexyl-POSS ($C_{48}H_{88}O_{14}Si_8$), octaglycidyldimethylsilyl-POSS ($C_{56}H_{120}O_{36}Si_{16}$), trisglycidylethyl-POSS ($C_{59}H_{114}O_{18}Si_{10}$), ethylundecanoateisobutyl-POSS ($C_{41}H_{88}O_{14}Si_8$), methylpropionateisobutyl-POSS ($C_{32}H_{70}O_{14}Si_8$), fluoro(3)disilanolcyclopentyl-POSS ($C_{40}H_{75}F_3O_{12}Si_8$), fluoro(13)disilanolisobutyl-POSS ($C_{38}H_{75}F_{13}O_{12}Si_8$), dodecatrifluoropropyl-POSS ($C_{36}H_{48}F_{36}O_{18}Si_{12}$), trifluorocyclohexyl-POSS ($C_{42}H_{77}F_3O_9Si_7$), trifluoropropylisobutyl-POSS ($C_{31}H_{67}F_3O_{12}Si_8$), chlorobenzylcyclohexyl-POSS ($C_{49}H_{83}ClO_{12}Si_8$), chlorobenzylethylcyclopentyl-POSS ($C_{44}H_{73}ClO_{12}Si_8$), chloropropylisobutyl-POSS ($C_{31}H_{69}ClO_{12}Si_8$), isocyanatopropyldimethylsilyl cyclohexyl-POSS ($C_{48}H_{89}NO_{14}Si_9$), acrylocyclohexyl-POSS ($C_{48}H_{86}O_{14}Si_8$), methacrylcyclopentyl-POSS ($C_{42}H_{74}O_{14}Si_8$), trismethacrylcyclohexyl-POSS ($C_{69}H_{128}O_{18}Si_{10}$), cyanoethylcyclohexyl-POSS ($C_{45}H_{81}NO_{12}Si_8$), cyanopropylcyclopentyl-POSS ($C_{39}H_{69}NO_{12}Si_8$), norbornenylethylcyclohexyl-POSS ($C_{51}H_{90}O_{12}Si_8$), trisnorbornenylcyclopentyl-POSS ($C_{68}H_{120}O_{12}Si_{10}$), diphenylphosphinoethylcyclopentyl-POSS ($C_{49}H_{77}O_{12}PSi_8$), diphenylphosphinopropylcyclopentyl-POSS ($C_{50}H_{79}O_{12}PSi_8$), poly(dimethyl-co-methylhydrido-co-methylpropyl-POSS)siloxane, poly(dimethyl-co-methylvinyl-co-methylethylsiloxy-POSS)siloxane, poly (ethylsilsesquioxane), poly(methylsilsesquioxane), poly (phenylsilsesquioxane), poly(propylmethacryl-POSS-co-methyl methacrylate), poly(propylmethacryl-POSS-co-styrene), poly(styryl-POSS-co-styrene), and poly (vinylsilsesquioxane).

30. A photoconductor comprised in sequence of a supporting substrate, a photogenerating layer comprised of a photogenerating pigment and a thiophosphate, and at least one charge transport layer comprised of at least one charge transport component, an optional thiophosphate, and a polyhedral oligomeric silsesquioxane containing material; and wherein said thiophosphate for both the photogenerating layer and charge transport layer is

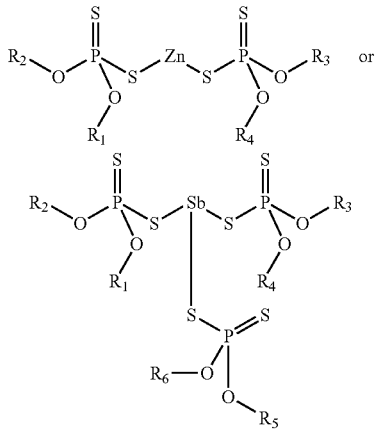

wherein $R_1$, $R_2$, $R_3$, $R_4$, $R_5$ and $R_6$ each independently represents at least one of a hydrogen atom, alkyl, cycloalkyl, aryl, alkylaryl and arylalkyl, and wherein said polyhedral oligomeric silsesquioxane containing material is present in an amount of from about 5 to about 20 weight percent, and said thiophosphate is present in an amount of from about 0.2 to about 5 weight percent in said charge transport layer and in said photogenerating layer.

31. A photoconductor in accordance with claim 30 wherein said oligomeric silsesquioxane is selected from the group consisting of polyhedral oligomeric silsesquioxane, polyhedral oligomeric silsesquioxane alcohols and phenols, polyhedral oligomeric silsesquioxane alkoxysilanes, polyhedral oligomeric silsesquioxane amines, polyhedral oligomeric silsesquioxane chlorosilanes, polyhedral oligomeric silsesquioxane epoxides, polyhedral oligomeric silsesquioxane esters, fluoroalkyl polyhedral oligomeric silsesquioxane, polyhedral oligomeric silsesquioxane halides, polyhedral oligomeric silsesquioxane isocyanates, polyhedral oligomeric silsesquioxane methacrylates and acrylates, polyhedral oligomeric silsesquioxane nitriles, norbornenyl polyhedral oligomeric silsesquioxane, polyhedral oligomeric silsesquioxane olefins, polyhedral oligomeric silsesquioxane phosphines, polyhedral oligomeric silsesquioxane silanes, polyhedral oligomeric silsesquioxane silanols, polyhedral oligomeric silsesquioxane thiols, polyhedral oligomeric silsesquioxane-containing polymers, and mixtures thereof.

32. A photoconductor in accordance with claim 30 wherein at least one of said charge transport layers contains a resin binder; said photogenerating layer is situated between said at least one charge transport and said substrate, and which charge transport layer contains a resin binder, said polyhedral oligomeric silsesquioxane (POSS)-containing material present in an amount of from about 1 to about 15 weight percent, and said thiophosphate is present in an amount of from about 0.4 to about 10 weight percent in both of said at least one charge transport layer and in said photogenerating layer; and wherein each of said at least ones are from 1 to about 4.

33. A photoconductor in accordance with claim 31 wherein said thiophosphate is molybdenum di(2-ethylhexyl)dithiophosphate, zinc diethyldithiophosphate, or antimony diamyldithiophosphate.

* * * * *